United States Patent [19]

Heck

[11] Patent Number: 4,811,881

[45] Date of Patent: Mar. 14, 1989

[54] APPARATUS FOR SUPPLYING AND INSTALLING PLASTIC EXPANSION RIVETS

[75] Inventor: Michael E. Heck, Boca Raton, Fla.

[73] Assignee: Phillips Plastics Corporation, Phillips, Wis.

[21] Appl. No.: 123,563

[22] Filed: Nov. 20, 1987

[51] Int. Cl.[4] ..... B21J 15/28

[52] U.S. Cl. ..... 227/4; 227/112; 227/156; 227/149

[58] Field of Search ..... 227/112, 4, 156, 149

[56] References Cited

U.S. PATENT DOCUMENTS

| | | | |
|---|---|---|---|
| 4,604,889 | 8/1986 | Sukhareusky | 227/112 X |
| 4,628,722 | 12/1986 | Mauer et al. | 227/112 X |
| 4,747,294 | 5/1988 | Schwartz et al. | 227/112 X |
| 4,765,175 | 8/1988 | Denham et al. | 227/117 X |

*Primary Examiner*—Paul A. Bell

*Attorney, Agent, or Firm*—James E. Nilles; Thomas F. Kirby

[57] ABSTRACT

Apparatus is disclosed for supplying and installing plastic expansion rivets with breakaway mandrels in holes in a workpiece. It comprises a hand-held, trigger actuated, pneumatically-operated installation tool; a rivet-supply mechanism for supply rivets one-by-one to the tool on a timely basis; and a vacuum-operated, mandrel-removal mechanism for removing broken away mandrels from the tool. The installation tool has a hollow barrel with a nose piece at its working end for receiving and releasably holding each rivet delivered thereto. Two piston assemblies are slidably mounted in the hollow barrel: one maintains the rivet body stationary against the workpiece and the other has jaws thereon for gripping and pulling on the rivet mandrel to expand the rivet body and break away the mandrel. The hollow barrel also contains a vacuum tube through which broken-away mandrels are expelled. A control system comprising pilot pressure operated control valves supplies compressed air to the tool to effect sequential movement of the piston assemblies. Other control valves in the control system supply air to operate the rivet supply mechanism. The various control valves are operated in proper timed sequence by a pneumatic logic circuit which is responsive to actuation of a trigger-operated valve on the tool.

16 Claims, 6 Drawing Sheets

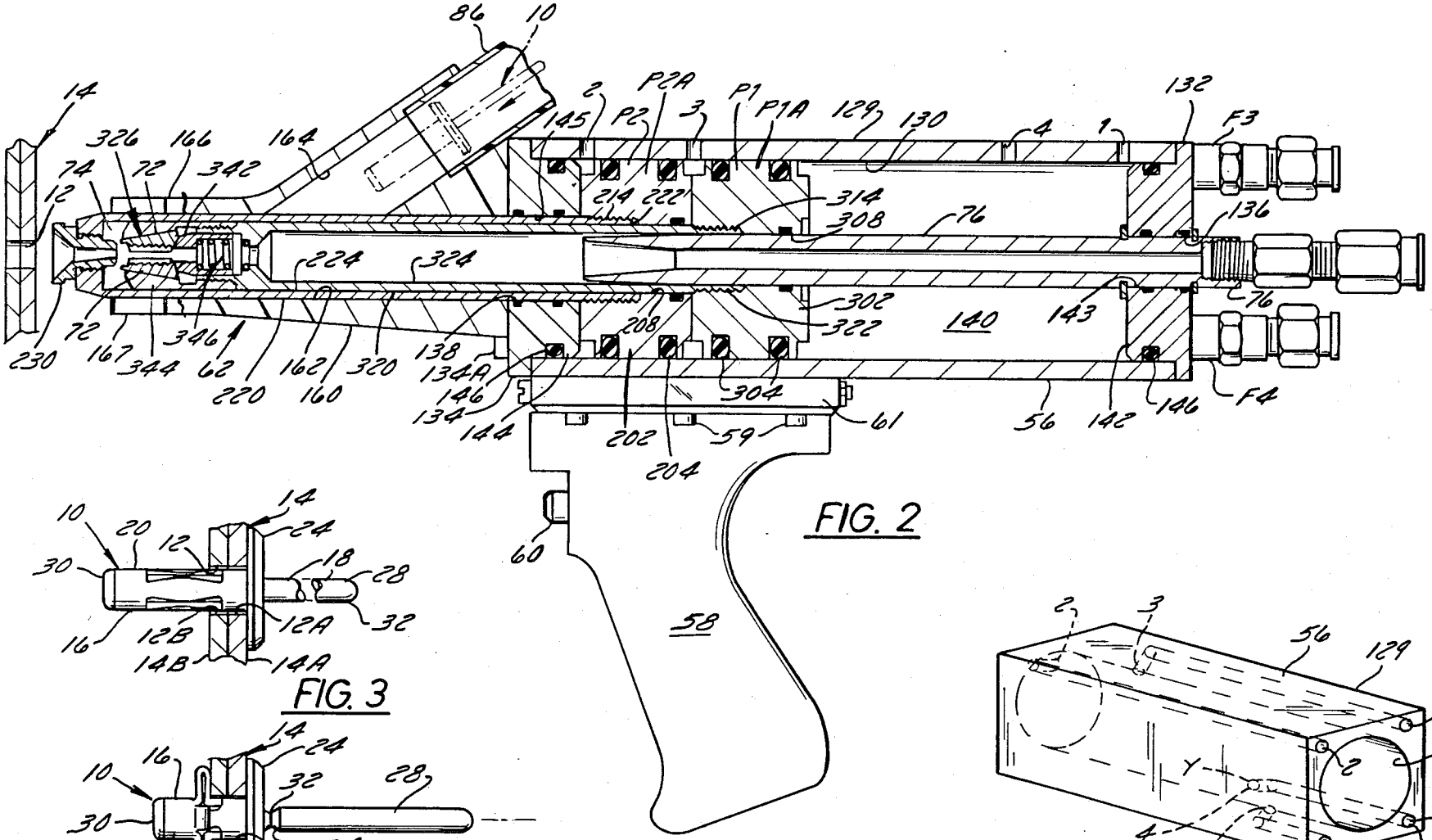
FIG. 2
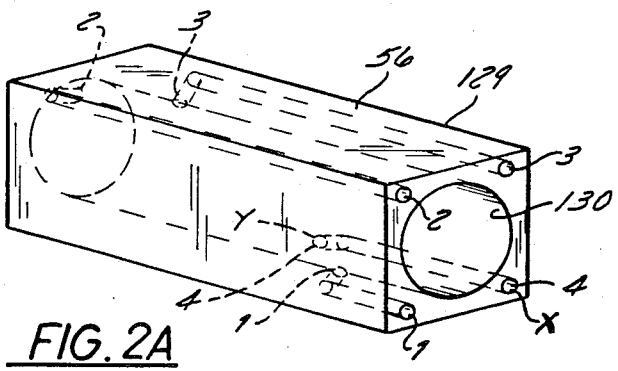
FIG. 2A
FIG. 3
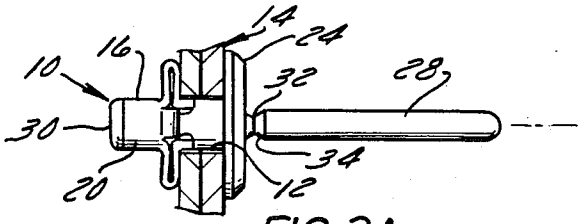
FIG. 3A

APPARATUS FOR SUPPLYING AND INSTALLING PLASTIC EXPANSION RIVETS

BACKGROUND OF THE INVENTION

1. Field of Use

This invention relates generally to apparatus for supplying and installing plastic expansion rivets in a hole in a workpiece. In particular, it relates to an improved expansion rivet installation tool for such apparatus and to improved means for operating such tool.

2. Description of the Prior Art

A typical expansion rivet comprises a hollow expandable rivet body and a mandrel or pin disposed in a bore in the rivet body. Such an expansion rivet is used, for example, to secure two flat panels together. In use, the unexpanded rivet body is inserted into aligned holes in the panels until a flange or head on the rivet body engages the outside of one panel. The flange is then held stationary against the panel while the mandrel is pulled axially to effect expansion of the rivet body shank on the outside of the other panel, whereby the panels are trapped between the rivet body flange and the expanded rivet body shank. Thereafter, if the mandrel has a breakaway portion, additional axial pulling force is exerted on the mandrel to cause that portion of the mandrel projecting from the rivet body to break away, whereupon the broken-away portion is discarded. Heretofore, hand-held manually operable tools of various types were employed to install expansion rivets having breakaway mandrels. Such tools required the user to install each expansion rivet in the tool, to manipulate the tool so as to insert the rivet body into the aligned holes in the panels to be joined, and to manually squeeze components of the tool to effect axial motion of the mandrel, expansion of the rivet body and breakaway of the projecting mandrel portion. This approach was time-consuming, tedious, costly and fatiguing for the tool-user who furnished manual power to operate the tool. Furthermore, broken-away mandrel portions in the form of small cylinders were usually discarded on the floor of the workplace and posed a risk that the tool-user or other persons might slip and fall. It is desirable, therefore, to provide improved apparatus and tools for supplying and installing expansion rivets.

U.S. Pat. No. 4,671,143 discloses an automatic screw feeding machine having driver jaws for a driver head. The jaws receive conventional slotted screws, one at a time, from a source and have a pair of oppositely disposed separable elongated cantilever springs which bias outwardly to receive and hold the screw. A reciprocably movable and rotatable screwdriver tip advances through a bore in the driver head, engages the slot in the screw head and rotates the screw into a threaded hole in a workpiece, whereupon the cantilever springs release the screw and reclose and the screwdriver tip retracts. However, this prior art automatic screw feeding machine is not usable to install expansion rivets.

SUMMARY OF THE INVENTION

Apparatus in accordance with the invention is provided for supplying and installing expansion rivets in holes in a workpiece. The expansion rivet comprises a hollow expandable rivet body having an axially movable breakaway mandrel or pin disposed in a bore in the rivet body. A plastic expansion rivet of a type suitable for use in the apparatus and tool in accordance with the present invention is disclosed in U.S. Pat. No. 4,556,351 which is owned by the same assignee as the present application.

The apparatus generally comprises an expansion rivet installation tool, rivet supply means for automatically supplying rivets to the installation tool, mandrel collection means for removing and collecting breakaway mandrel portions from the installation tool, and operating means, including control means, for operating the rivet supply means, the tool and the mandrel collection means.

The installation tool, which is manually held and manipulated by a human operator to effect rivet installation in a hole in a workpiece, generally comprises an elongated hollow barrel having a front (working) end and a rear end, a pistol grip on the barrel, and an operating trigger on the pistol grip. The hollow barrel is provided externally at its front (working) end with a nose piece which receives and releasably holds a rivet supplied from the rivet supply means. The hollow barrel is provided internally with two independently movable piston assemblies, each of which is reciprocably movable between an extended position (toward the front end of the barrel) and a retracted position (toward the rear end of the barrel). The hollow barrel also comprises a stationary mandrel collection tube therein. The first piston assembly, when extended, operates to engage a rivet being held in the nose piece and disposed in the hole in the workpiece and to hold it stationary against the workpiece. The second piston assembly comprises jaws, which, when the second piston assembly is extended, are located in a passageway in the already-extended first piston assembly and are ready to grip the mandrel. When the second piston assembly is retracted (while the first piston assembly is still extended), the jaws grip the mandrel and axially pull on it to effect expansion of the rivet body in the workpiece hole and to effect breakaway of a portion of the mandrel. When the first piston assembly is retracted (after the second piston assembly is retracted), it causes the jaws to open and release the broken-away mandrel portion into the mandrel collection tube, whereupon the collection means, which are vacuumized, remove that portion from the tool through the mandrel collection tube stationarily mounted within the tool barrel.

The rivet supply means comprise a motor-driven vibratory bowl for supplying rivets, one-by-one, to a metering device, including an escapement mechanism, from whence each is fed by compressed air through a flexible hose to the tool nose piece. The metering device is controlled and timed by the control means so that a rivet reaches the nose piece during an interval of time when both piston assemblies in the tool are in retracted position.

The two piston assemblies in the barrel of the installation tool are operated in proper timed sequences and moved to their various operating positions by compressed air which is selectively supplied from an air compressor through a plurality of valves operated in proper timed sequence by a pre-programmed adjustability pneumatic control device in response to manual actuation of the trigger on the tool.

The mandrel collection means comprise a mandrel collection container which is connected by a flexible vacuum hose to the mandrel collection tube in the tool barrel. The mandrel collection container, vacuum hose and mandrel collection tube are continually maintained under vacuum by a motor-driven vacuum pump connected to the mandrel collection container.

The apparatus and installation tool in accordance with the present invention offer numerous important advantages over the prior art. For example, operation is completely automatic and a human operator or robot needs only to depress and release a trigger on the tool to effect each complete cycle of operation, from delivery of a rivet to the tool, through setting of the rivet in a hole in a workpiece, to disposal of a broken-away mandrel portion. The tool, as disclosed, depends on compressed air and vacuum for operation and has no potentially dangerous electrical components thereon or electrical wires connected thereto. However, if preferred, the tool could be vacuum-operated or could be modified so that the piston assemblies are moved electrically as by motor or solenoids. The time of one cycle of operation can be easily adjusted by the operator to suit rivet size and installation conditions. Hand-delivery of individual rivets to the tool and manual operation of the tool is entirely eliminated, thereby saving time and effort and speeding productivity. Broken-away mandrel portions are safely disposed of automatically, thereby resulting in a clean and safe work place. The apparatus is simple and safe to operate and reliable in use. Other objects and advantages of the invention will hereinafter appear.

DESCRIPTION OF THE DRAWINGS

FIG. 2 is an enlarged cross-section view of a rivet installation tool in accordance with the invention and which is shown in FIG. 1;

FIG. 2A is a perspective view of the tool barrel showing air ports therein;

FIG. 3 is an enlarged side elevation view of an unexpanded rivet usable with the invention;

FIG. 3A is a view similar to FIG. 3 showing the rivet expanded;

DESCRIPTION OF A PREFERRED EMBODIMENT

General Arrangement

Figure 1:
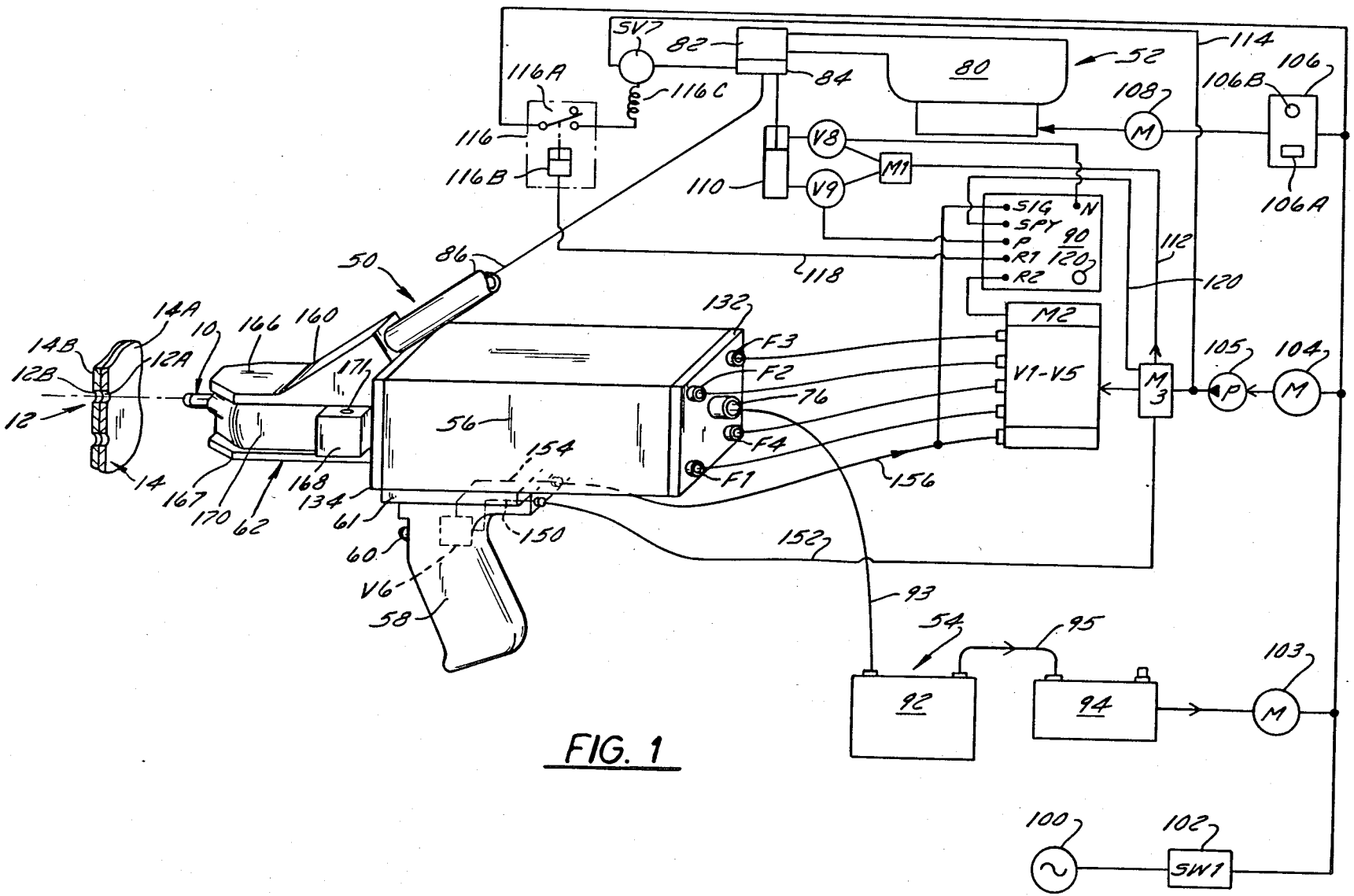
FIG. 1 is a schematic view of apparatus in accordance with the invention.

FIG. 1 schematically depicts apparatus in accordance with the invention for supplying and installing a two-piece plastic expansion rivet 10 in a hole 12 in a workpiece 14. The workpiece 14 takes the form of two panels 14A and 14B disposed in face-to-face abutting relationship and having holes 12A and 12B, respectively, therein which align to define hole 12.

FIGS. 3 and 3A show that rivet 10 comprises a hollow expandable rivet body 16 and a breakaway mandrel or pin 18. When fully installed in hole 12 (FIGS. 9 and 13), rivet 10 acts to secure the panels 14A and 14B together. Body 16 comprises a slotted expandable body shank 20 and a body head 24. Mandrel 18 comprises a mandrel shank 28, a mandrel head 30, and a breakaway mandrel portion 32 connected to the mandrel shank 28 by a narrow frangible portion 34. Mandrel 18 is axially movable in the direction of arrow A (FIG. 12) by tool 50, hereinafter described, to effect expansion of body 16. Further exertion of force on breakaway portion 32 by tool 50 in the direction of arrow A (FIG. 13) causes portion 32 to break away from mandrel shank 28.

Referring to FIG. 1, the apparatus generally comprises an expansion rivet installation tool 50, rivet supply means 52 for automatically supplying rivets 10 to the installation tool, mandrel collection means 54 for removing and collecting breakaway mandrel portions 32 from the installation tool, and operating means, including control means, for operating the rivet supply means 52, the tool 50 and the mandrel collection means 54.

The installation tool 50, which is manually or robot-held and manipulated by a human operator or robot controls to effect rivet installation in hole 12 in workpiece 14, generally comprises an elongated hollow barrel 56 having a front (working) end and a rear end, a pistol grip 58 on the barrel, and an operating trigger 60 on the pistol grip. The hollow barrel 56 is provided externally at its front (working) and with a nose piece 62 which receives and releasably holds a rivet 10 supplied from the rivet supply means 52.

Figure 7:
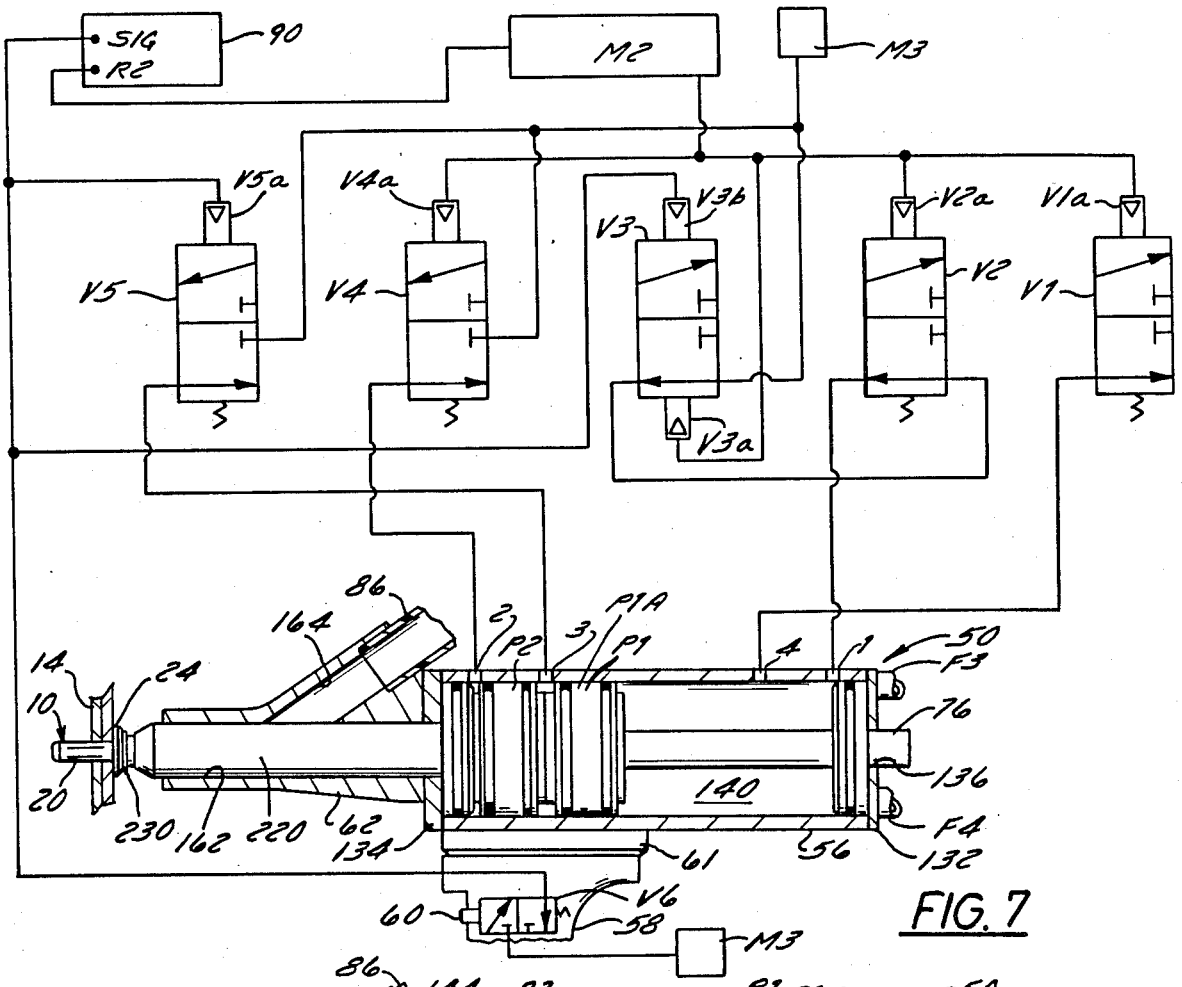
FIG. 7 is a pneumatic circuit diagram of the control valve assembly shown in FIG. 1, and showing it connected to the tool.
Figure 8:
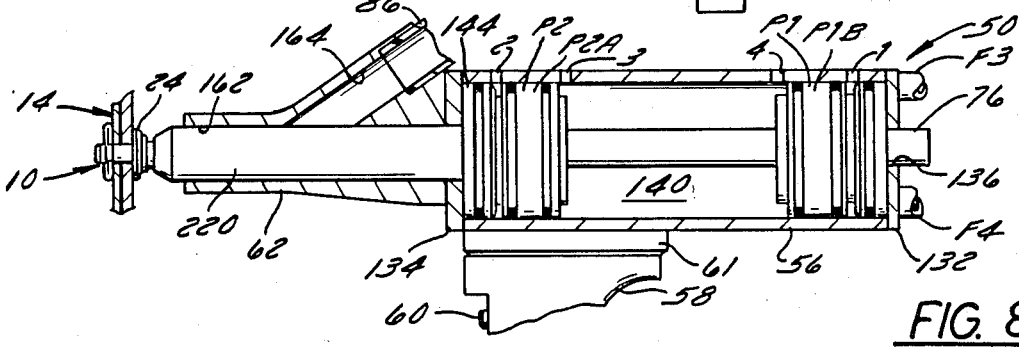
FIGS. 8 and 9 are side elevation views, partly in cross-section, depicting a series of operating positions of tool components during part of one cycle of operation.
Figure 9:
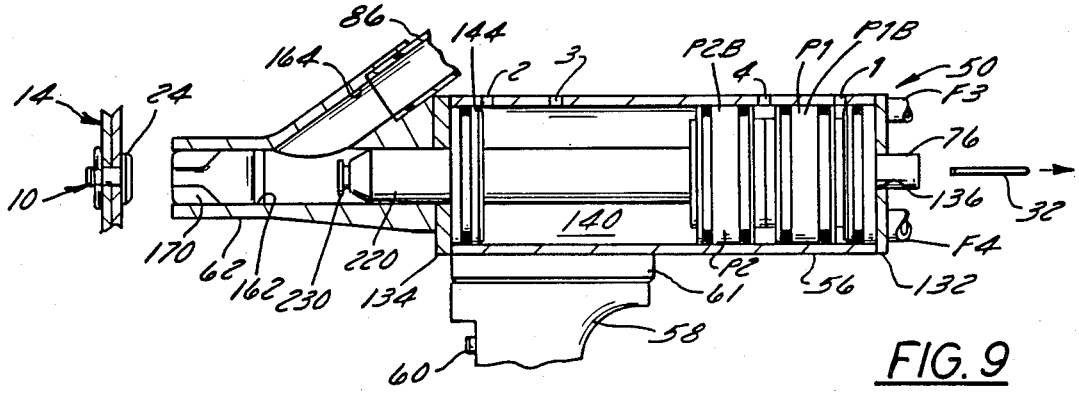
Figure 10:
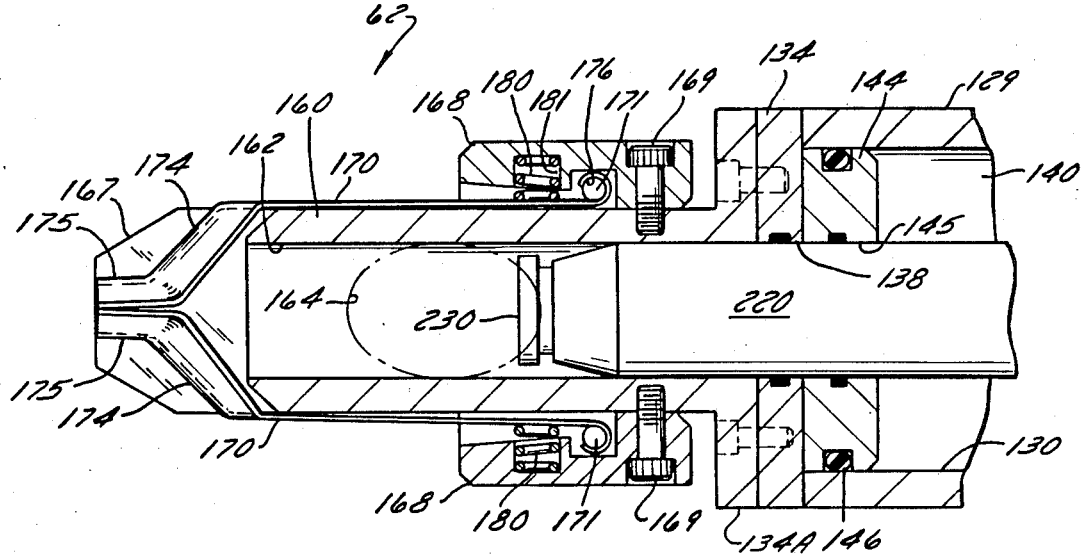
FIGS. 10, 11, 12, 13 and 14 are enlarged cross-section views also depicting portions of the tool components during various stages of operation.
Figure 11:
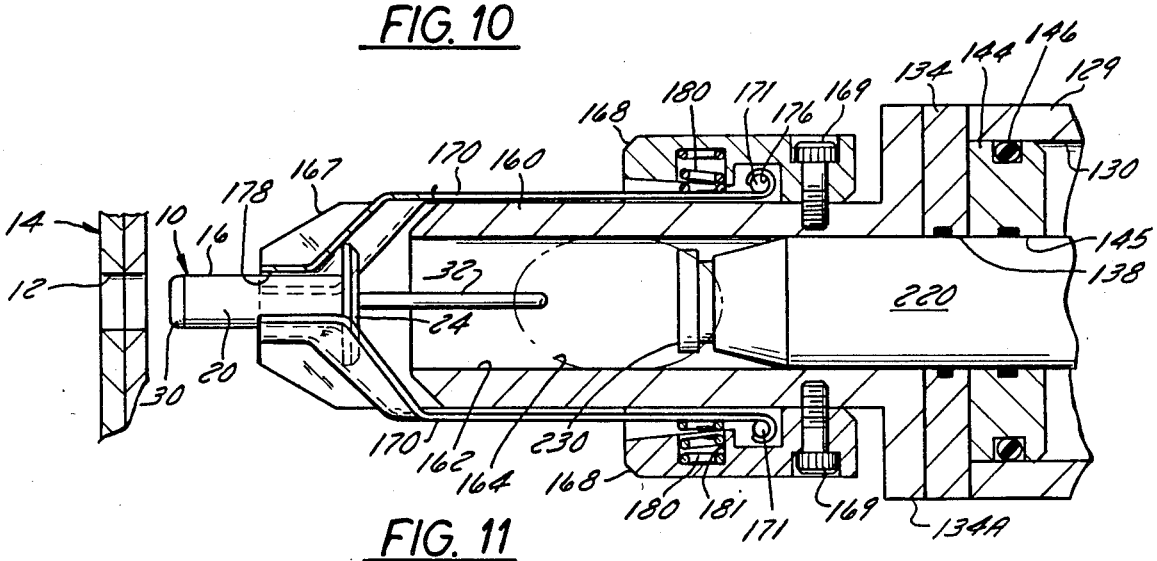
Figure 12:
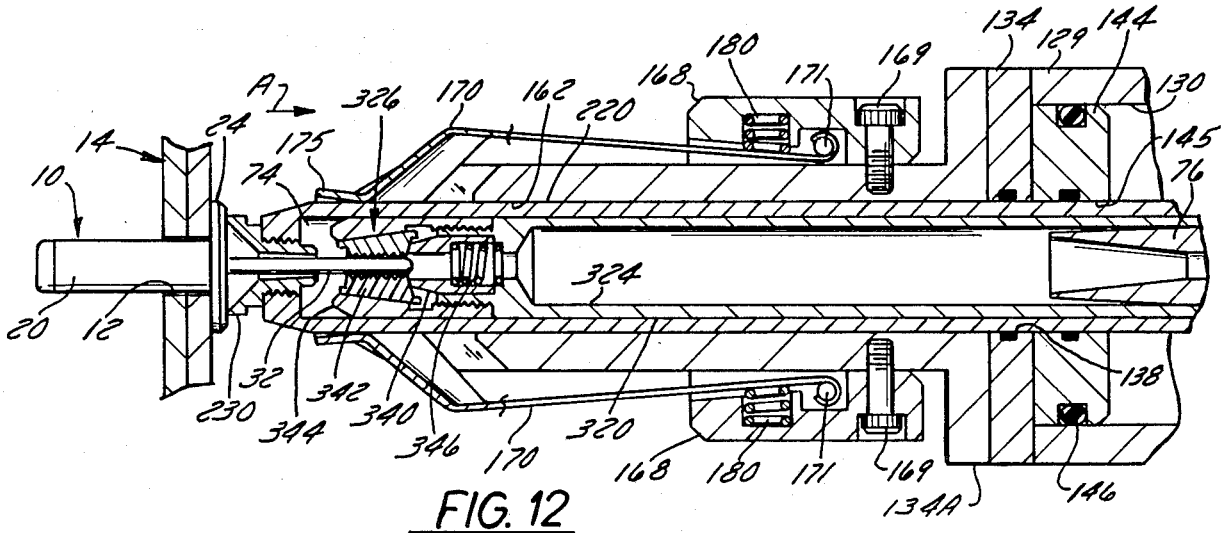
Figure 14:
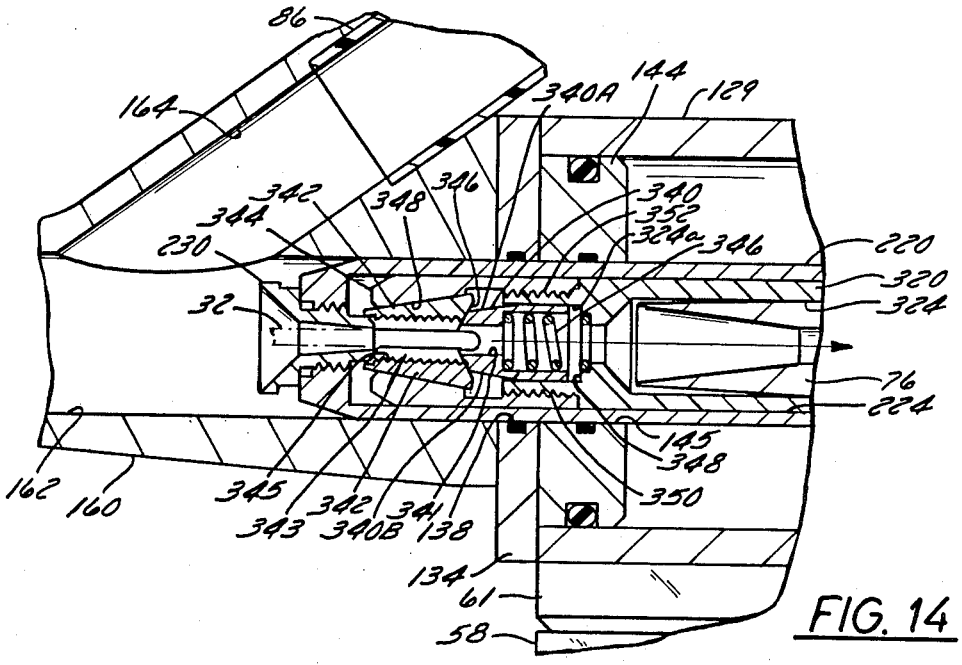
Figure 15:
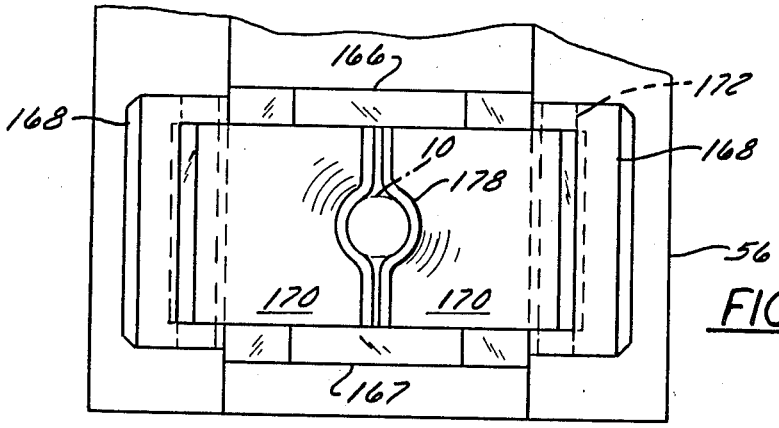
FIG. 15 is an enlarged end elevation view of the nose piece on the tool.
Figure 13:
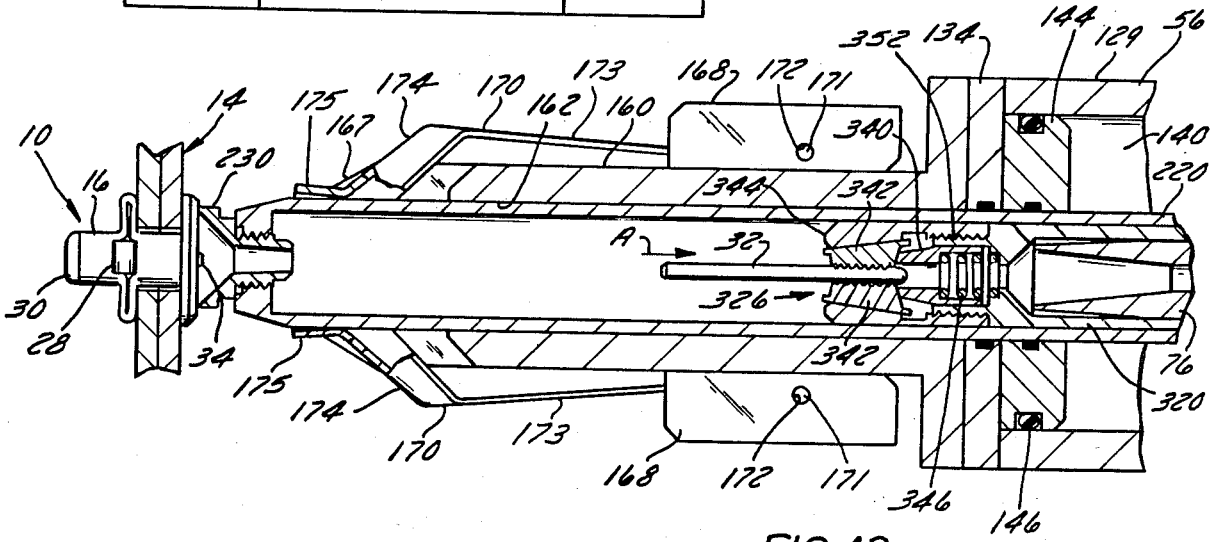

As FIG. 2 shows, the hollow barrel 56 is provided internally with two independently movable piston assemblies P1 and P2, each of which is reciprocably movable between an extended position (toward the front end of the barrel) and a retracted position (toward the rear end of the barrel). As comparison of FIGS. 7, 8 and 9 show, piston assembly P1 has an extended position designated P1A and a retracted position designated P1B. Piston assembly P2 has an extended position designated P2A and a retracted position designated P2B. As will be understood, the piston assemblies are in the positions P1A and P2A in FIGS. 1, 2, 3, 7 and 12. The piston assemblies are in positions P1B and P2A in FIGS. 8 and 13. The piston assemblies are in positions P1B and P2B in FIGS. 9, 10, 11 and 14. As FIGS. 7 and 12 show, the piston assembly P2, when extended, operates to engage the body head 24 of a rivet 10 being held in nose piece 62 and disposed in hole 12 in workpiece 14 and to hold it stationary against the workpiece. The piston assembly comprises jaws 72 (FIGS. 2 and 12) which, when piston assembly P1 is extended, move through a passageway 74 in the already-extended piston assembly P2 and engage the mandrel 32. As FIGS. 12 and 13 show, piston assembly P1 is retracted (while piston assembly P2 is still extended), the jaws 72 grip mandrel 18 and axially pull on it in the direction of arrow A to effect expansion of rivet body shank 20 in workpiece hole 12 and to effect breakaway of portion 32 of the mandrel. When piston assembly P2 is retracted (after piston assembly P1 is retracted, as shown in FIGS. 9 and 14), it causes jaws 72 to open and release broken-away mandrel portion 32, whereupon collection means 54 remove that portion from tool 50 through a collection tube 76 stationarily mounted within the tool barrel.

Referring again to FIG. 1, the rivet supply means 52 comprise a motor-driven vibratory bowl 80 for supplying rivets, one-by-one, to a metering device 82, including an escapement mechanism 84, from whence each is fed by compressed air through a flexible hose 86 to tool nose piece 62. Compressed air is supplied from a compressed air manifold M3 hereinafter described. The metering device 82 is controlled, as hereinafter explained, so that a rivet 10 reaches nose piece 62 during an interval of time when both piston assemblies P1 and P2 in tool 50 are in retracted position.

The two piston assemblies P1 and P2 in tool 50 are operated in proper timed sequences and moved to their various operating positions by compressed air from compressed air manifold M3 which is selectively supplied therefrom by means of a plurality of pneumatic control valves designated V1 through V5 (see FIGS. 1 and 7) to a plurality of air ports designated 1, 2, 3 and 4 (see FIGS. 1, 2 and 7) provided in tool barrel 56. The pneumatic control valves V1–V5, in turn, are operated in proper timed sequence by a pre-programmed adjustability pneumatic control device 90 (FIGS. 1, 4, 5, 6 and 7) in response to manual actuation of trigger 60 on tool 50. Trigger 60 comprises a two-position valve V6 (FIGS. 1 and 7).

The mandrel collection means 54 comprises a mandrel collection container 92 which is connected by a flexible vacuum hose 93 to mandrel collection tube 76 in the tool barrel. The mandrel collection container 92, vacuum hose 93 and mandrel collection tube 76 are continually maintained under vacuum by a motor-driven vacuum pump 94 connected to mandrel collection container 92 by a hose 95.

Referring to FIG. 1, operation is generally as follows. Tool 50 is held by the person (or robot) who will manipulate it. A rivet 10 which was previously automatically supplied to nose piece 62 of tool 50 from fastener supply means 52 projects from the nose piece (FIGS. 1, 7, 11 and 12). The tool 50 is then manipulated to effect insertion of the insertion end of rivet 10 into hole 12 in workpiece 14 (FIGS. 7 and 12). When trigger 60 on tool 50 is pulled, the tool operates to effect expansion of rivet 10 and break-away of breakaway portion 32 of the rivet (FIGS. 8 and 13). Removal means 54 operates to effect expulsion of breakaway portion 32 from tool 50 (FIGS. 13 and 9). Fastener supply means 52 then operates to automatically supply a new rivet 10 to tool 50 (FIG. 11).

As FIG. 1 shows, the operating means for the apparatus generally comprise a source of electric power 100; a master on/off electric switch 102; an electric motor 103 for continuously driving vacuum pump 94; an electric motor 104 for continuously driving an air compressor 105 which continuously supplies compressed air to a compressed air manifold M3, to trigger 60 and to a compressed air valve SV7; and an on/off electric controller 106 for an electric motor 108 for vibratory bowl 80.

In rivet supply means 52, the electric controller 106 includes a manually operable on/off switch 106A to control energization of motor 108 and further includes a manually operable rheostat 106B to control motor speed and, therefore, the rate of vibration (i.e., feed rate) of bowl 80 which supplies rivets 10 one-at-a-time to metering device 82. Metering device 82 includes an escapement mechanism 84 operated by a compressed air cylinder 110 which, when extended, prevents a rivet 10 from entering tube 86 and, when retracted, permits a rivet to enter tube 86. Extension and retraction of cylinder 110 is controlled by normally-closed three-way pilot valves V9 and V8, respectively, in response to operation of pneumatic control device 90 as hereinafter described. The pilot valves V8 and V9 control air flow from an air manifold M1 to cylinder 110. Air manifold M1 is supplied from air manifold M3 through air supply line 112. The pilot ports of the valves V8 and V9 are connected to the ports N and P, respectively, of control device 90. Metering device 82 further comprises the electrically operated solenoid valve SV7 which is supplied with compressed air from air compressor 105 through an air supply line 114. When closed, valve SV7 prevents compressed air flow into tube 86 and, when open, admits a burst of air to enter tube 86 behind a rivet 10 therein for a length of time sufficient to propel it into nose piece 62 of tool 10. The solenoid coil 116C of valve SV7 is electrically connected through the normally-open contacts 116A of a pressure switch 116 to electric power source 100. The pressure responsive actuator 116B of pressure switch 116 is connected by an air line 118 to port R1 of device 90.

Manifold M3, in addition to supplying air to manifold M1 and to trigger 60 as above described, also supplies compressed air through an air line 120 to an air supply port SPY on control unit 90 and to the control valves V2, V3, V4 and V5 and from thence to tool 50 as hereinafter explained. As FIG. 7 shows, a manifold M2 supplies compressed air from a control port R2 on control unit 90 to effect operation of pilot valves V1*a*, V2*a*, V3*a* and V4*a*, as hereinafter explained.

Figure 6:
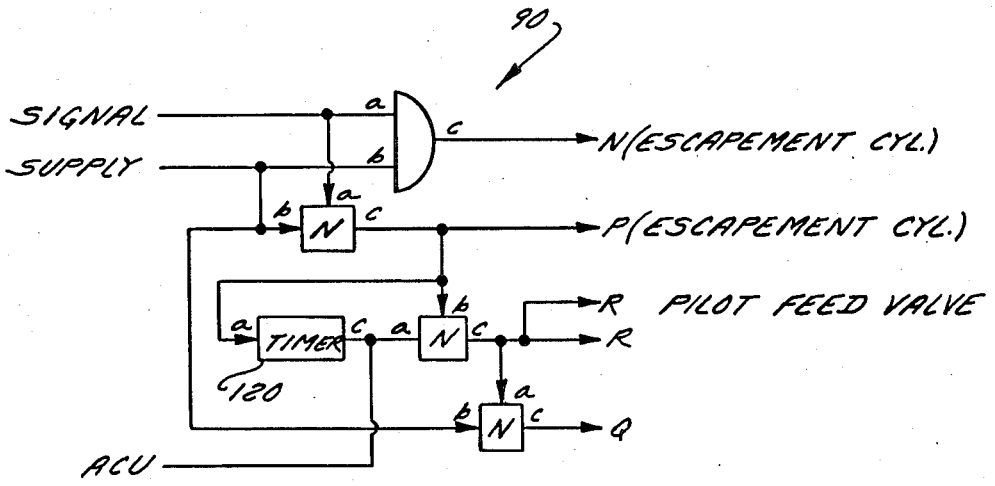
FIG. 6 is a simplified pneumatic circuit diagram of the pneumatic control device shown in FIGS. 1, 4, 5 and 7.
Figure 4:
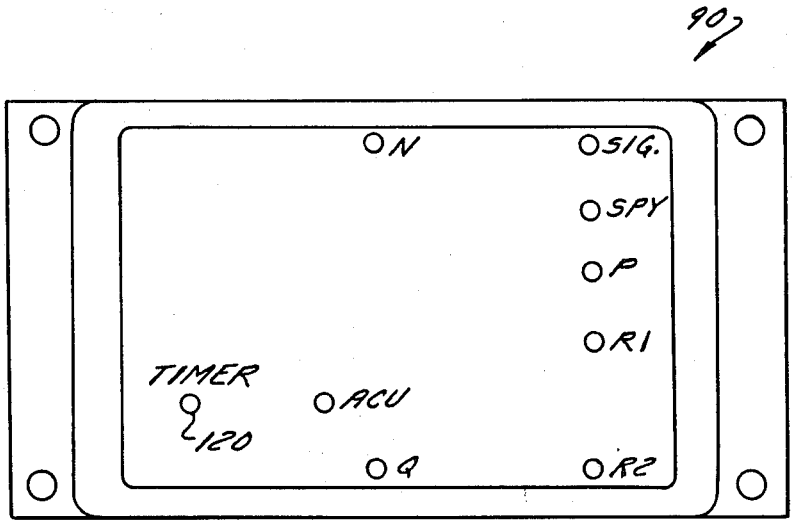
FIGS. 4 and 5 are enlarged top plan and side elevation views, respectively, of a pneumatic control device of the control means of FIG. 1.
Figure 5:
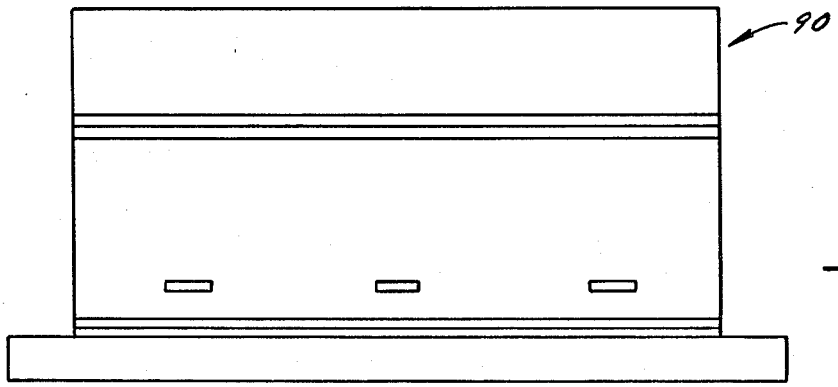

As FIGS. 1, 4, 5, 6 and 7 make clear, control device 90, which takes the form of a hollow box-like structure (FIGS. 4 and 5), is provided on its upper surface with a plurality of air ports (FIGS. 1, 4 and 6), hereinafter described, and is provided on its interior with pneumatic components forming a pneumatic control circuit which is connected to the ports as shown in FIG. 6. Control device 90 comprises a manually adjustable timer component 120, hereinafter described. Control device 90 commences to perform part of its control function cycle when trigger 60 is depressed and completes the remainder of its control function cycle within an adjustable interval of time when the trigger is released. The air ports on control device 90 include air supply port SPY connected to compressor 105; a signal port S1G connected to valve V6 of trigger 60; air output ports N and P connected to pilot valves V8 and V9, respectively; port R1 connected to the pressure switch 116 for the pilot feed valve SV7; and port R2 connected to the air manifold M2.

Installation Tool

Referring to FIGS. 1, 2 and 2A, the barrel 56 of installation tool 50 comprises elongated hollow housing 129 having a front (working) end and a rear end and having a bore 130 therethrough. Bore 130 is closed at its rear end by a rear end plate 132 and is closed at its front end by a front end plate 134, both rigidly affixed to housing 129, and those end plates have center holes 136 and 138, respectively, therethrough. Front end plate 134 serves as the base plate of nose piece 62. The central hole 136 in rear end plate 132 accommodates stationary tube 76 which extends into bore 130. The central hole 138 in front plate 134 accommodates a tube 220, hereinafter described, which is part of piston assembly P2. In order to ensure that barrel 56 has a cylinder chamber 140 of proper length therein, stationary spacer elements 142 and 144, which are integral with plates 132 and 134, of appropriate thickness are provided at the rear and front ends, respectively, of bore 130 and the O-rings 146 thereon ensure that they remain sealed. The spacer elements 142 and 144 have central holes 143 and 145, respectively, therethrough.

As FIG. 2A shows, housing 129 has a rectangular external cross-sectional configuration (but could be circular or some other shape) and bore 130 has a circular cross-sectional configuration. Housing 129 is provided with four air ports 1, 2, 3 and 4 which, in an actual embodiment, are arranged along and around bore 130 as shown in FIG. 2A. Each port 1 through 4 is formed by drilling a passage, such as X, longitudinally inwardly from the rear end of housing 129 and by drilling a cross-passage, such as Y, near the inner end of a passage X. The passages X of the ports 1, 2, 3 and 4 then register with and connect to air hose fittings designated F1, F2, F3 and F4, respectively, on rear end plate 132. However, for purposes of simplification in explaining the invention, the ports 1, 2, 3 and 4 are shown in FIGS. 2 and 7 as located along the same side of bore 130.

Handle 58 is connected to the underside of housing 129 by screws 59. Trigger 60 is mounted on handle 58 and, as FIG. 7 shows, takes the form of a manually depressible two-position valve which is spring-biased to the position shown in FIG. 7. A valve plate 61 is entrapped between housing 129 and handle 58 and includes an air passage 150 for connecting the compressed air inlet side of trigger valve V6 to manifold M3 by means of a flexible air hose 152. Plate 61 further includes an air passage 154 for supplying air from the air outlet side of trigger valve V6 to the valves V3 and V5 and to signal port S1G of control device 90 through an air hose 156, as hereinafter explained.

Nose Piece

Referring to FIGS. 1, 2 and 10 through 15, nose piece 62 comprises a base plate which takes the form of front end plate 134A on barrel 56 and further comprises a nose body 160 rigidly secured to end plate 134A. Nose body 160 and end plate 134A have a cylindrical nose bore 162 extending axially therethrough which is axially aligned with hole 138 in plate 134 and with cylinder bore 130 in housing 129. Nose bore 162 has a diameter which is slightly greater than the diameter of the rivet body head 24. Nose body 160 also has a rivet supply bore 164 on its upper side which intersects with and has the same diameter as nose bore 162. Rivet supply bore 164 is connected to hose 86 of fastener supply means 52 and enables a rivet 10 to be admitted into nose bore 162. Nose piece 62 is provided with two integrally formed flat upper and lower guide plates 166 and 167, respectively, which project forwardly from its front end. Upper and lower guide plates 166 and 167 are spaced apart from each other by a distance which is the same as the diameter as nose bore 162. Nose piece 62 further comprises a pair of spring retainer members 168, each of which is rigidly secured as by screws 169 to one lateral side of nose body 160. Nose piece 62 also comprises a pair of cantilever springs 170, each of which is pivotally mounted at its rear end on a respective spring retainer member 168 by a spring mounting pin 171 which is secured in holes 172 (FIG. 13) on the spring retainer member 168. Each cantilever spring 170 is made of resilient material (such as spring steel) and comprises a flat elongated portion 173, a flat inwardly bent transition portion 174, and an outer end portion 175. The rear end of flat elongated portion 173 of each cantilever spring 170 is bent to define a hole 176 for accommodating its associated mounting pin 171. The front edge of portion 175 is shaped to define a semicylindrical recess 178 (FIG. 15) which has a slightly greater diameter than the diameter of the unexpanded rivet body shank 20 of rivet 10. A pair of helical compression springs, such as spring 180, is disposed between each spring retainer member 168 and its associated cantilever spring 170. Each spring 180 is mounted in a recess 181 in the inner side of a spring retainer member 168 and is entrapped therein by the associated cantilever spring 170. When there is no rivet 10 in tool 50 (see FIG. 10), the cantilever springs 170 are biased by the compression springs 180 against the lateral edges of the guide plates 166 and 167 of nose body 160. When a rivet 10 enters nose bore 162 from supply bore 164 under the action of compressed air in hose 86, the unexpanded body shank 20 of rivet 10 enters into the cylindrical space defined by the recesses 178 of the pair of cantilever springs 170 and the latter pivot outwardly against the bias of the compression springs 180 to accommodate and hold the rivet 10 (see FIG. 11). When piston assembly P2 advances to position P2A, the compression springs 170 open wider to accommodate tube 220 thereof.

Piston Assemblies

Referring to FIG. 2, the aforementioned piston assembly P1 comprises a piston 302 which is slidably mounted in cylinder bore 130 and, when at rest, is located near the front end of bore 130 in position P1A. Piston 302 has a pair of sealing O-rings 304 of elastomeric material mounted thereon. Piston 302 has an axial piston bore 308 therethrough. The rear portion of piston bore 308 is of sufficient diameter to slidably accommodate vacuum tube 76 which extends therethrough. The front portion of piston bore 308 is internally threaded as at 314. Piston assembly P1 further comprises an extension tube 320 which has external threads 322 at its rear end which engage the internal threads 314 in piston bore 308 in piston 302. Tube 320, which has a bore 324 there-through, is provided with a mandrel gripping mechanism 326 at its front end, as hereinafter described. Bore 324 in tube 320 slidably accommodates stationary vacuum tube 76 which extends thereinto.

As FIGS. 2, 12, 13 and 14 show, mandrel gripping mechanism 326 comprises a jaw ramp 340, a pair of separable jaws 342, and a collet 344. The front end of extension tube 320 of piston assembly P2 comprises a bore portion 324A in which jaw ramp 340 is disposed. Jaw ramp 340 comprises two ramp sections 340A and 340B defining a hole 341 which can accommodate mandrel 32 and which are biased outwardly of bore portion 324A by a helical compression spring 346 located in bore portion 324A between the rear end of jaw ramp 340 and a shoulder 348 formed in bore portion 324A. The tapered front end of jaw ramp 340 extends into a tapered bore portion 346 defined by the pair of separable jaws 342. The jaws 342 further comprise a bore portion 343 for receiving the breakaway portion 32 of mandrel 18. Bore 343 has threads 345 which define teeth to facilitate gripping. The tapered front end of the pair of jaws 342 extends into a tapered bore 348 in collet 344. Collet 344 has internal threads 350 which threadedly engage an external thread 352 on the front end of extension tube 320. Normally, spring 346 biases jaw ramp 340 outwardly and maintains the jaws 342 closed. However, in operation, when jaw ramp 340 is biased forwardly by spring 346, the jaws 342 close. Conversely, when jaw ramp 340 is forced rearwardly, the jaws 342 open.

The aforementioned piston assembly P2 comprises a piston 202 which is slidably mounted in cylinder bore 130 and, when at rest, is located in position P2A. Piston 202 has a pair of sealing rings 204 mounted thereon. Piston 202 has an axial piston bore 208 therethrough. The rear portion of piston bore 208 is of sufficient diameter to slidably accommodate extension tube 320 of piston assembly P1 which extends therethrough. The front portion of piston bore 208 is internally threaded as at 214. Piston assembly P2 further comprises an extension tube 220 which has external threads 222 at its rear end which engage the internal threads 214 in piston bore 208 in piston 202. Tube 220, which has a bore 224 therethrough, is the same outside diameter as the nose bore 162 in nose piece 62 into which it is extendable. Bore 224 in tube 220 is of sufficient diameter to slidably accommodate the mandrel gripping assembly 326 of piston assembly P1 which extends thereinto. Tube 220 has a hollow tip member 230 at its front end which is adapted to bear against the body head 24 of a rivet 10 during installation. Tip member 230 extends into bore 224 and cooperates with the mandrel gripping mechanism 326. When tip member 230 engages the jaws 342 and forces them rearwardly, the jaws open to receive the mandrel portion 32. When tip member 230 disengages from the jaws 342, the jaws are spring biased forwardly to closed position to grip the mandrel portion 32 (see FIG. 13).

Operation

Initially assume that the piston assemblies P1 and P2 are in positions P1A and P2A and are at rest, as shown in FIG. 2, and that rivet 10 is not in tool 50. Further assume that rivet supply means 52 and mandrel collection means 54 are energized for operation. Also assume that air compressor 105 is in operation and that air manifolds M3 and M1 are charged, that escapement mechanism 84 of metering device 82 is closed, that control device 90 is charged but not yet actuated, and that trigger 60 is not yet depressed.

Referring now to FIG. 7, when trigger 60 is depressed, trigger valve V6 shifts from the position shown in FIG. 7 to its other position. Pilot pressure then flows from manifold M3, through trigger valve V6, to pilot valve V3*b* of control valve V3, to pilot valve V5*a* of control valve V5, and to signal port SIG of control device 90.

Control valve V5 shifts from the blocked position shown in FIG. 7; and compressed air flows from manifold M3, through control valve V5 to port 3 in tool 50 to cause piston assembly P1 to move from position P1A to position P1B.

Control valve V3 shifts from the position shown in FIG. 7 to its other position and allows air to exhaust from cylinder chamber 140, through port 1 in tool 50, through control valve V2 (which is in the position shown in FIG. 7), and through shifted control valve V3 to atmosphere. However, piston assembly P2 remains in position P2A.

Pilot pressure to signal port SIG of control device 90, which is already supplied with air at supply port SPY from manifold M3, shifts (reverses) the output signals from P to N of control device 90. Thus, with port P pressurized, pilot valve V9 is actuated to extend the escapement cylinder 110 and thereby open the escapement mechanism 84 so that a rivet 10 can leave vibratory bowl 80 and enter flexible hose 86.

At this point in the cycle, nothing further happens until trigger 60 is released and trigger valve V6 is allowed to return to the position shown in FIG. 7. When trigger 60 is released, pilot pressure to pilot valve V5*a* is exhausted through trigger valve V6 and control valve V5 returns to the position shown in FIG. 7 and blocks the exhaust from port 3 on tool 50. Pilot pressure to pilot valve V3*b* on control valve V3 is also exhausted through trigger valve V6; however, control valve V3 does not return to the position shown in FIG. 7. Pilot pressure to signal port SIG on control device 90 is also exhausted through trigger valve V6 and this causes control device 90 to provide a timed output signal to appear at output ports R1 and R2 of device 90. The time length of this signal can be adjusted by manipulation of timer component 120 of control device 90.

The timed output signal from port R1 of control device 90 provides pilot pressure to the actuator 116B of pressure switch 116 and thereby causes electric switch controls 116A to close and energize solenoid coil 116C of solenoid valve SV7. Solenoid valve SV7 then opens to admit compressed air to hose 86 and force rivet 10 through the hose toward nose piece 62 of tool 50.

The timed output signal from port R2 of control device 90 provides pilot pressure to air manifold M2 which supplies pilot pressure to the pilot valves V1*a*, V2*a*, V3*a* and V4*a* for the control valves V1, V2, V3 and V4, respectively.

Control valve V4 shifts from the position shown in FIG. 7 to its other position and supplies air from manifold M2, through valve V4 to port 2 on tool 50 thereby causing piston assembly P2 to move (retract) from position P2A to position P2B.

At the same time control valve V1 shifts from the position shown in FIG. 7 to its other position and allows air to exhaust from port 4 of tool 50 through control valve V1 to atmosphere thereby enabling piston assembly P2 to assume its retracted position P2B.

When both piston assemblies P1 and P2 are retracted, the rivet 10 being blown through hose 86 enters the nose piece 62 of tool 50 (see FIG. 11).

Pilot pressure on pilot valve V3*a* from manifold M2 causes control valve V3 to return to the position shown in FIG. 7 and allows air to flow from manifold M3, through control valve V3, to control valve V2. However, since pilot valve V2*a* of control valve V2 is still receiving a timed flow of pilot pressure from manifold M2 and control valve V2 has assumed a position other than that shown in FIG. 7, air from control valve V3 cannot pass through control valve V2 until port R2 of control device 90 times out.

When such time-out occurs, control valve V1 returns to the position shown in FIG. 7 and blocks port 4 of tool 50. At the same time, control valve V2 returns to the position shown in FIG. 7 to supply air from manifold M3, through control valve V3 and through control valve V2 to port 1 of tool 50. Air pressure at port 1 of tool 50 causes both piston assemblies P1 and P2 to advance together from their retracted positions P1B and P2B toward and into their extended positions P1A and P2A. At the same time, control valve V4 shifts back to the position shown in FIG. 7 and allows air to exhaust from port 2 of tool 50 as the piston assemblies advance.

At this stage of the cycle, the components of tool 50 are advancing from FIG. 11 through the position shown in FIG. 12 and toward that shown in FIG. 7 and the tool operator is able to manipulate the tool so as to insert the rivet 10 into hole 12 in workpiece 14. When this is done, the condition shown in FIG. 7 exists.

When the operator again depresses trigger 60, the entire cycle of movement of the piston assemblies P1 and P2 hereinbefore described is repeated. However, as FIG. 14 shows, as piston assembly P1 begins to retract, its jaws 72 close upon and grip mandrel portion 32 of rivet 10. When piston assembly P1 is fully retracted, as shown in FIGS. 8 and 13, the rivet body shank 20 is fully expanded and mandrel portion 32 is broken away but is still gripped by the jaws 72. However, when piston assembly P2 is fully retracted, as shown in FIGS. 9 and 14, the engagement between the inside end of tip member 230 of piston assembly P2 with the jaws 72 on piston assembly P1 causes the jaws 342 to move rearwardly and open to release mandrel portion 32 which is then expelled by vacuum from tube 76, through vacuum hose 93 into container 92.

I claim:

1. Apparatus for supplying and installing expansion rivets, each of which has an expandable body and a relatively movable breakaway mandrel, said apparatus comprising:

an installation tool having a housing with a bore therethrough and comprising rivet holding means on said housing for releasably holding a rivet exteriorily of said bore, a pair of relatively movable components in said bore, each component comprising a hollow piston and a tube and being independently movable between an extended position and a retracted position, the tube of one component slidably receiving the tube of the other component, the tube of said other component having jaws thereon, and a mandrel-receiving tube in said bore and slidably received in the tube of said other component;

supply means operable to supply an expansion rivet through said bore to said rivet holding means on said tool and exteriorily of said bore;

mandrel removal means operable to remove a broken-away mandrel from said mandrel-receiving tube on said tool;

and means for effecting:

movement of both said components to extended position wherein the tube of said one component engages the body of a rivet in said rivet holding means and wherein the jaws of said other component releasably grip the mandrel of the rivet;

movement of said other component to its retracted position to effect movement of said mandrel, expansion of said rivet body and break away of said mandrel;

movement of said one component to its retracted position whereby its tube operates said jaws to effect release of the broken-away mandrel from said other component into said mandrel-receiving tube for removal by said mandrel removal means;

movement of both components back to retracted position;

and operation of supply means to supply a rivet through said bore to said rivet holding means before said both components return to extended position.

2. Apparatus for supplying and installing an expansion rivet in a hole in a workpiece, said rivet comprising an expandable rivet body having a breakaway mandrel therein, said apparatus comprising:

an installation tool comprising a hollow barrel having a bore therein, a nose piece on said barrel for releasably holding exteriorily of said bore an expansion rivet supplied thereto, a first piston assembly movably mounted within said bore and comprising a hollow first piston and a first tube extending therefrom, a second piston assembly movably mounted within said bore and comprising a hollow second piston and a second tube extending therefrom, said second tube having mandrel-gripping jaws thereon for releasably gripping said mandrel, said second tube being slidably received with said first tube, each of said piston assemblies being movable between a respective retracted position and an extended position, and a stationary mandrel-receiving tube mounted within said bore and slidably received within said second tube for receiving a broken away mandrel;

means for supplying an expansion rivet to said nose piece while both piston assemblies are in their retracted positions;

means for moving said first piston assembly from its retracted position to its extended position wherein the first tube thereof extends from said bore and engages the body of a rivet held by said nose piece exteriorily of said bore to maintain it in a fixed position;

means for moving said second piston assembly from its retracted position to its extended position wherein said jaws releasably grip said mandrel;

means for moving said second piston assembly from its extended position toward its retracted position while said jaws grip said mandrel and while said first piston assembly maintains the rivet body in fixed position whereby said mandrel is moved axially and effects expansion of the rivet body; and whereby said jaws effect break-off of the breakaway portion of the mandrel as said second piston assembly continues to move axially toward its retracted position after the rivet body has been expanded;

means for moving said first piston assembly to its retracted position after said jaws release the grip on said mandrel;

and means connected to said mandrel-receiving tube of said tool for removing the broken-off portion of the mandrel from said tube.

3. Apparatus according to claim 2 wherein said means for moving said first and second piston assemblies comprises:

a plurality of ports in said hollow barrel;

a source of compressed air;

a plurality of valves selectively operable for controlling fluid flow into and out of said ports to effect movement of said piston assemblies;

and control means selectively operable for operating said valves in a predetermined sequence to effect movement of said first and second piston assemblies.

4. Apparatus according to claim 3 wherein said control means comprises a trigger operated valve on said tool to initiate operation of said control means.

5. Apparatus according to claim 3 wherein said means for supplying an expansion rivet through said bore to said nose piece comprises a supply of rivets, an escapement mechanism selectively operable to supply a rivet through said bore to said nose piece, and wherein said control means is further operable to effect operation of side escapement mechanism.

6. Apparatus according to claim 5 wherein said control means comprises a trigger operated valve on said tool to initiate operation of said control means.

7. Apparatus according to claim 3 wherein said means connected to said tool for removing the broken-off portion of said mandrel from said mandrel-receiving tube comprises a container connected to said mandrel-receiving tube, and a source of vacuum connected to said container and to said mandrel-receiving tube.

8. An installation tool for receiving and installing an expansion rivet having an expandable body and a relatively movable breakaway mandrel, said tool having a housing and a bore therethrough and comprising:

(A) rivet holding means for receiving said rivet through said bore and releasably holding said rivet exteriorily of said bore, (B) movable component means operable to expand said rivet body and to break away said mandrel, and movable between extended and retracted positions, said movable component means comprising two relatively movable components, each component being independently movable between an extended position and a retracted position, each component comprising a hollow piston slidable in said bore and a tube affixed thereto; one of said components being operable, when its tube is in extended position, to extend from said bore and engage said rivet body and hold it stationary in said rivet holding means; the other of said components being operable, when its tube is in extended position, to engage said mandrel and being further operable when moving toward retracted position, to move said mandrel to effect expansion of said rivet body and breakaway of said mandrel; said one component being further operable, when returning toward retracted position, to engage said other component and effect release of the broken-away mandrel therefrom, (C) a mandrel-receiving tube mounted within said bore and slidably receivable in said tube of said other component to receive a broken-away mandrel, (D) and a trigger means actuatable between tow positions;

said trigger means being actuatable from one position to another position to effect movement of said component means from extended to retracted position and to enable a rivet to be supplied through said bore to said rivet holding means, said trigger means being actuatable from said other position back to said one position (i) to effect movement of said one component to extended position wherein its tube moves into engagement with said rivet body in said rivet holding means, (ii) to effect movement of said other component from retracted position to extended position and into gripping engagement with said mandrel and from extended position to retracted position to effect (a) expansion of said rivet body (b) break away of said mandrel (c) and release of the broken-away mandrel into said mandrel-receiving tube for subsequent removal in response to movement of said one component toward retracted position.

9. Apparatus according to claim 8 wherein said tube of said other component comprises releasable mandrel-gripping jaws.

10. Apparatus according to claims 18 or 19 wherein each of said components comprises a piston having a hole therethrough, and wherein said tube is open at both ends and connected to said piston in alignment with the hole therethrough.

11. A tool for receiving and installing an expansion rivet, said rivet comprising an expandable hollow body and a mandrel in said body axially movable to effect expansion of said body, said tool comprising:

a barrel having a barrel bore therein, said barrel bore being closed at its rear end by an end wall;

said barrel being provided with a plurality of fluid ports communicating with said barrel bore;

a nose piece at the front end of said barrel and exteriorly of said barrel bore for receiving an expansion rivet expelled from said barrel bore, said nose piece having a nose piece bore therethrough in registry with the front end of said barrel bore, said nose piece having a receiving bore therein communicating with said nose piece bore for receiving and directing a rivet into said barrel bore and from thence into said nose piece bore, a pair of separable cantilever springs mounted on opposite sides of said nose piece and releasably engageable with the body of a rivet disposed in said nose piece bore to maintain said rivet exteriorily of said barrier bore;

first and second piston assemblies movably mounted in said barrel bore, a each piston assembly being movable between a respective rear position near the rear of said barrel bore and an advanced position near the front of said barrel bore;

said first piston assembly comprising a first piston slidably mounted in said barrel bore and a first tube connected to and extending forwardly from said first piston and axially aligned with a first hole through said first piston, said first tube being slidably receivable in said nose piece bore when said first piston assembly is in its advanced position;

said second piston assembly comprising a second piston slidably mounted in said barrel bore and a second tube connected to and extending forwardly from said second piston and axially aligned with a second hole through said second piston, said second tube being slidably receivable in said first tube of said first piston assembly;

said second piston assembly further comprising mandrel gripping means mounted on the forward end of said second tube for releasably gripping the mandrel of a rivet held in said nose piece when said second piston assembly is in its advanced position and for exerting an axial pulling force on the mandrel when said second piston assembly moves toward its rear position;

and a mandrel-receiving tube rigidly mounted in said barrel bore and extending forwardly from said barrel bore end wall into said second tube of said second piston assembly, said mandrel-receiving tube being open at both ends and adapted to receive a broken-away mandrel through its front end and to expel it through its rear end.

12. Apparatus for supplying and installing an expansion rivet having an expandable body and a relatively movable breakaway mandrel, said apparatus comprising:

(1) an installation toll having a housing with an axial bore therethrough and comprising (A) rivet holding means on the exterior of said housing for releasably holding said rivet exteriorly of said bore, (B) movable component means within said bore and operable to expand said rivet body and to break away said mandrel, and movable between extended and retracted positions, said movable component means comprising two relatively movable components, each component comprising a piston slidably mounted in said bore, said piston having a hole therethrough, and a tube open at both ends and connected to said piston in alignment with the hole therethrough, the tube of one component slidably receiving the tube of said other component, each component being independently movable between an extended position and a retracted position; said one component being operable, when in extended position, to extend from said bore and engage said rivet body and hold it stationary in said rivet holding means; said other component comprising releasable mandrel gripping jaws and being operable, when in extended position, to engage and grip said mandrel and being further operable when moving toward retracted position, to move said mandrel to effect expansion of said rivet body and breakaway of said mandrel; said one component being further operable, when returning toward retracted position, to engage said other component and effect release of the broken-away mandrel from the jaws thereof;

(C) a mandrel-receiving tube stationarily mounted on said housing within said bore to receive a broken-away mandrel, said mandrel-receiving tube being slidably receivable within the tube of said other component, (D) and a trigger means actuatable between two positions;

(2) supply means operable to supply said expansion rivet to said bore for movement to said rivet holding means;

(3) mandrel removal means operable to remove said broken-away mandrel form said mandrel-receiving tube;

(4) and control means;

(A) said control means being responsive to actuation of said trigger means from one position to another position (i) to effect movement of said component means from extended to retracted position (ii) and to effect operation of said supply means to supply said rivet to said rivet holding means, (B) said control means being responsive to actuation of said trigger means from said other position back to said one position (i) to effect movement of said one component to extended position into engagement with said rivet body in said rivet holding means, (ii) to effect movement of said other component from extended position to retracted position to effect (a) expansion of said rivet body (b) break away of said mandrel (c) and release of the broken-away mandrel into said mandrel-receiving tube for removal by said mandrel removal means in response to movement of said one component toward retracted position.

13. Apparatus according to claim 12 wherein said movable component means of said tool and said supply means are operable by compressed air, wherein said trigger means comprises a trigger valve, and wherein said control means comprises selectively operable control valves operable in response to actuation of said trigger valve to effect operation of said component means and said supply means.

14. Apparatus according to claim 13 wherein said control means further comprises a pneumatic control circuit responsive to actuation of said trigger valve for operating said control valves in a predetermined sequence.

15. Apparatus according to claim 14 wherein said mandrel removal means are operable by vacuum.

16. Apparatus according to claim 15 wherein said mandrel removal means comprises a vacuumized mandrel collection container connected to said mandrel-received tube on said tool.

* * * * *